US006385939B1

(12) United States Patent
Stout

(10) Patent No.: US 6,385,939 B1
(45) Date of Patent: May 14, 2002

(54) BULLNOSE CLADDING SYSTEM

(75) Inventor: Jeffry B. Stout, White Lake, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 0 days.

(21) Appl. No.: 09/833,850

(22) Filed: Apr. 12, 2001

Related U.S. Application Data

(60) Provisional application No. 60/215,569, filed on Jun. 30, 2000.

(51) Int. Cl.[7] ..... E04C 2/38

(52) U.S. Cl. ..... 52/718.01; 52/222; 52/717.03; 52/287.1; 52/311.1

(58) Field of Search ..... 52/222, 287.1, 52/311.1, 311.3, 290, 718.01, 718.06, 717.03, 716.8, 717.05, 273

(56) References Cited

U.S. PATENT DOCUMENTS

| | | | | |
|---|---|---|---|---|
| 4,040,223 A | | 8/1977 | Hillstrom | |
| 4,399,640 A | * | 8/1983 | Porter | 52/202 |
| 4,606,167 A | | 8/1986 | Thorne | |
| 4,696,136 A | * | 9/1987 | Grewe | 52/222 |
| 4,823,533 A | | 4/1989 | Hillstrom | |
| 5,070,666 A | * | 12/1991 | Looman | 52/239 |
| 5,150,554 A | | 9/1992 | Quinlan, Jr. et al. | |
| 5,273,258 A | * | 12/1993 | Bedics | 256/59 |
| 5,380,120 A | * | 1/1995 | Vermeulen | 403/405.1 |
| 5,406,762 A | * | 4/1995 | Buard | 52/287.1 |
| 5,694,726 A | * | 12/1997 | Wu | 52/287.1 |
| 5,881,528 A | * | 3/1999 | Grewe et al. | 52/721.4 |
| 6,009,683 A | | 1/2000 | Grewe et al. | |
| 6,148,585 A | | 11/2000 | Baker | |
| 6,192,646 B1 | | 2/2001 | Grewe et al. | |

* cited by examiner

*Primary Examiner*—Carl D. Friedman
*Assistant Examiner*—Jennifer I. Thissell
(74) *Attorney, Agent, or Firm*—Harness, Dickey & Pierce, P.L.C.

(57) ABSTRACT

A bullnose cladding system is provided which gives an outward appearance of a generally arcuate or semi-circular surface extending from an otherwise planar surface. The bullnose cladding system is constructed using a pair of parallel mounting rails which hold one or more outwardly bowed flexible plastic panels. The longitudinal edges of the plastic panels are folded under to create a hem which releasably secures the panel within the longitudinal rails. Various corner members and expansion joints may be utilized to provide a finished look to the bullnose cladding system.

33 Claims, 3 Drawing Sheets

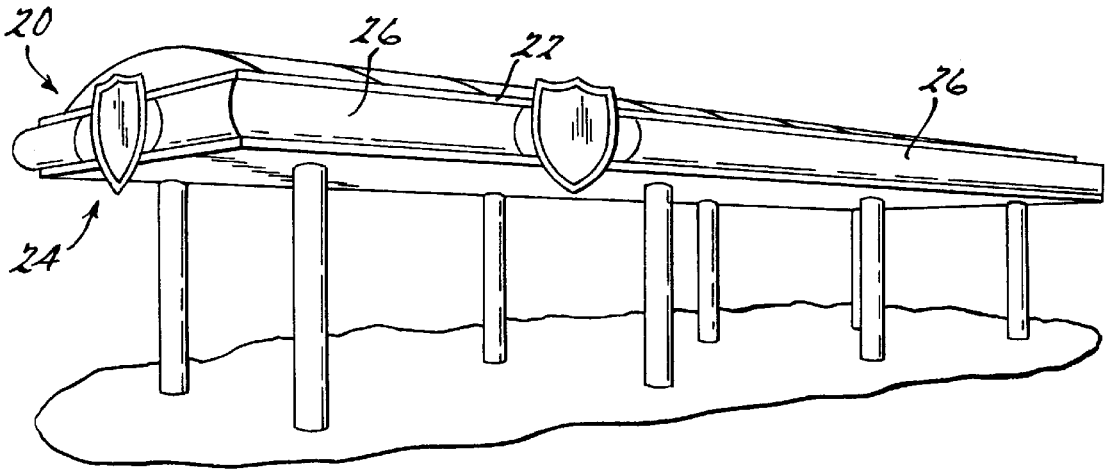
FIG. 1.
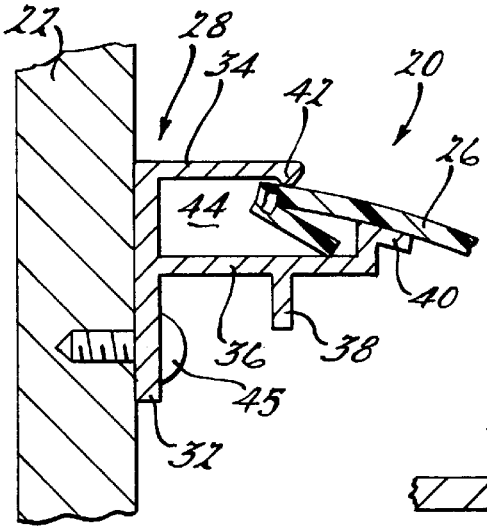
FIG. 2.
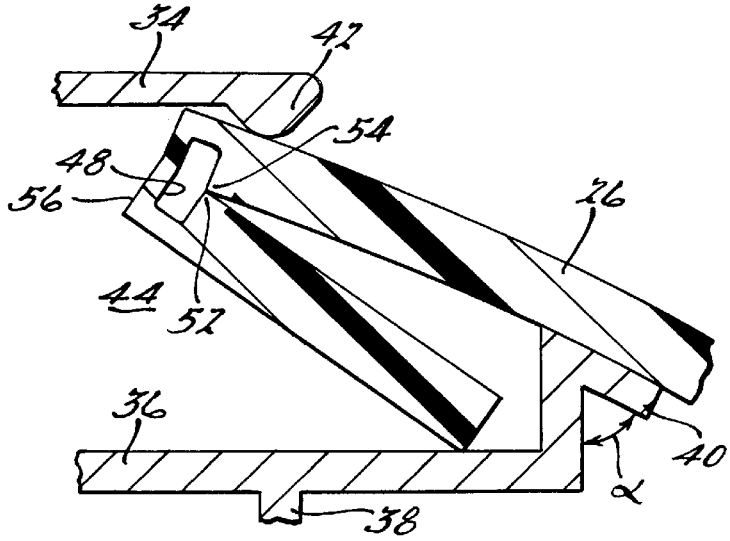
FIG. 3.
FIG. 4a.
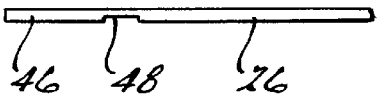
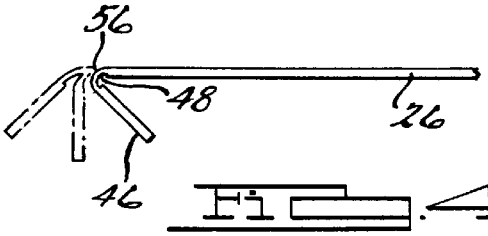
FIG. 4b.

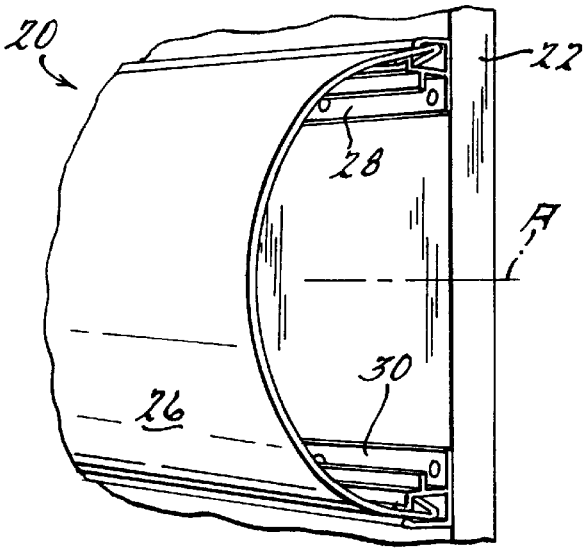
FIG. 5d.
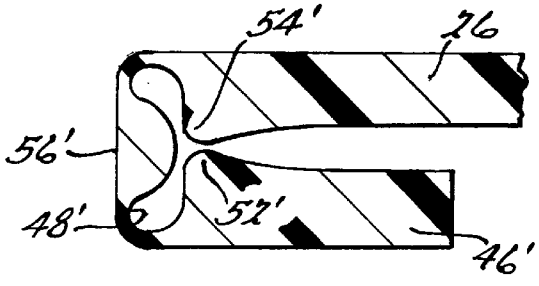
FIG. 5.
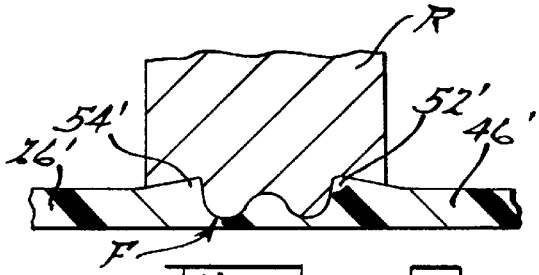
FIG. 6.
FIG. 6a.
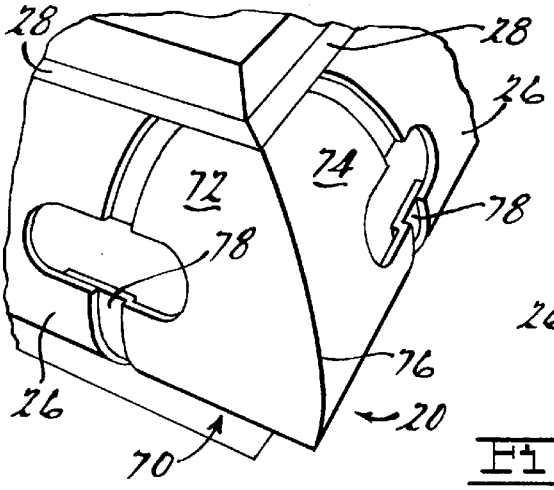
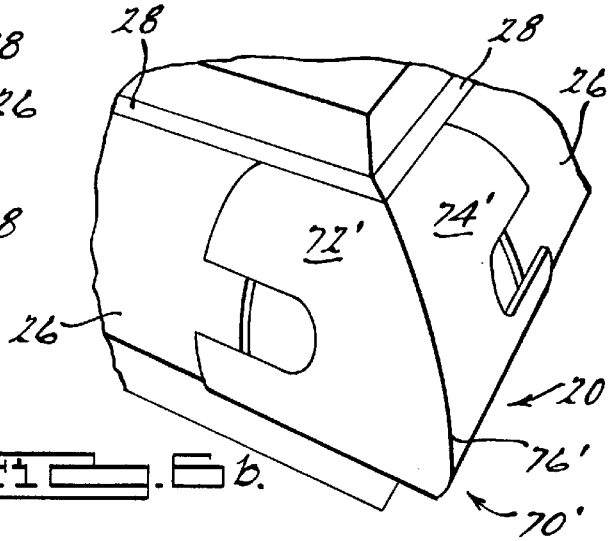
FIG. 6b.
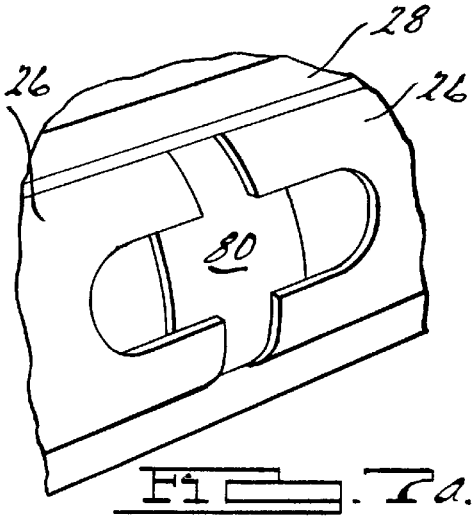
FIG. 7a.
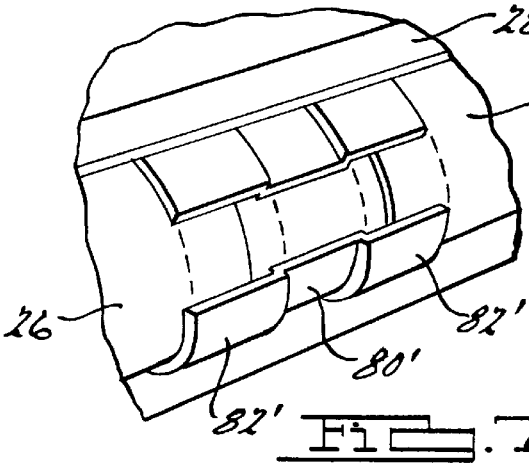
FIG. 7b.

BULLNOSE CLADDING SYSTEM

CROSS-REFERENCE TO RELATED APPLICATIONS

The present invention claims priority to U.S. Provisional Application No. 60/215,569, filed on Jun. 30, 2000 pursuant to 35 U.S.C. § 119 (e).

BACKGROUND OF THE INVENTION

The present invention relates generally to an ornamental fascia for use on a building structure and more particularly to a bullnose cladding system for adorning various exposed surfaces of a structure.

It is now customary for chain stores and franchise realtors to use a standardized appearances on various structure attendant to their business in order to convey a common recognizable theme to the products and/or services offered thereby. A standardized appearance is also useful in order to convey the nature of the business or to convey a theme.

Often the building architecture or attendant structure of a particular store or franchise will vary from one building to another. Because of these architectural differences, it is sometimes necessary to use building adornments in order to convey a theme or a standardized appearance. Ideally such adornments should be inexpensive, easy to install and should require low maintenance. Given the wide variance in building architecture, these objectives may be difficult and expensive to achieve.

SUMMARY OF THE INVENTION

In order to fulfill the need for a simple and relatively inexpensive building adornment, the present invention provides a construction, apparatus and method for providing a bullnose cladding for attachment to a building structure or attendant fixture. The bullnose cladding system includes a pair of elongated rail members attached to the surface of the structure onto which the bullnose cladding is to be secured. A panel or plurality of panels are inserted within channels formed in the rails for releasably securing the cladding to the structure. The individual panels are formed with a living hinge which allows the panel to be folded to form a hem on the back side of the panel which is inserted within the channel to create a self-locking joint. By utilizing a hem, additional fastening elements such as pins or clips are not needed. The bullnose cladding system further includes various expansion joint assemblies which may be interdisposed between adjacent panels to accommodate thermal expansion as a result of change in the ambient temperatures. Similarly, the bullnose cladding system further includes various corner assemblies which are used to provide a mitered or rounded effect at corners of the bullnose cladding system while at the same time allowing for expansion of the adjacent panels. As such, the invention is well adapted for storage, shipment and assembly in a modular or kit form.

It is an object of the present invention to provide an improved covering or cladding for buildings, structures, poles, columns and attendant fixtures.

It is also an object of the present invention to provide a low-cost system for covering or highlighting such items which can be easily assembly.

It is a further object of the present invention to provide a cladding system which has a minimum number of parts that are easy to install and replace where necessary.

It is still a further object of the present invention to provide a cladding system which has mostly flat and/or non-preformed components in order to minimize packaging and freight expenses.

It is yet another object of the present invention to provide a cladding system which accommodates thermal expansion of the individual components, while at the same time maintaining a uniform, pleasing appearance.

These and other objects and purposes of the present invention will become apparent from the following description of invention which viewed in accordance with the attached drawings and appended claims. Thus, for a more complete understanding of the invention, reference may be had to the following detailed description of the preferred embodiment and accompanying drawings.

BRIEF DESCRIPTION OF THE DRAWINGS

FIG. 1 is a perspective view of a canopy incorporating the bullnose cladding system of the present invention;

FIG. 2 is a detailed cross-section of a longitudinal rail and a portion of the panel for the bullnose cladding system illustrated in FIG. 1;

FIG. 3 is a further detail of the interconnection of the rail and the panel illustrated in FIG. 2;

FIGS. 4*a*–4*d* illustrate the insertion of the panel into the rail;

FIGS. 5*a*–5*d* illustrate the fabrication of the bullnose fascia in accordance with the present invention;

FIGS. 6*a* and 6*b* illustrate various corner pieces to be used in conjunction with the bullnose fascia;

FIGS. 7*a* and 7*b* illustrate various expansion joints to be used in conjunction with the bullnose fascia;

FIG. 8 is a detail cross-sectional view of an alternate preferred embodiment of the cladding panel in accordance with the present invention; and FIG. 9 is a detail illustration showing the forming of the cladding panel depicted in FIG. 8.

DESCRIPTION OF THE PREFERRED EMBODIMENT

Figure 4C:
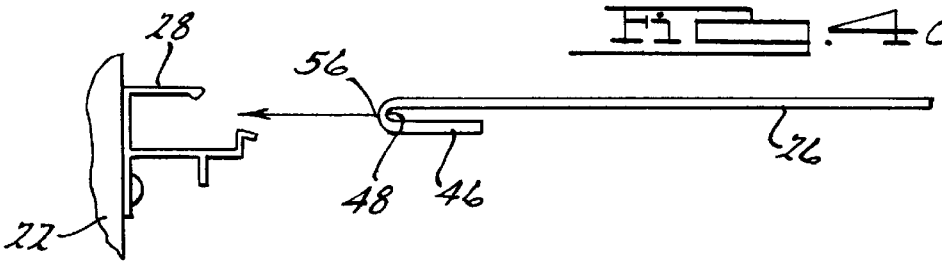

Referring to FIG. 1, the bullnose cladding system of the present invention is illustrated generally at 20. The cladding 20 is secured to a vertical face 22 of a building 24. For illustration purposes, building 24 is generally represented as a canopy having a plurality of corners defining vertical faces. While the present invention is generally illustrated as providing cladding to a vertical face of a building structure, one skilled in the art will readily recognize that the cladding system of the present invention could be utilized in other applications such as being generally vertically oriented to provide a cylindrical appearance. The present invention represent further improvements to various cladding systems disclosed in U.S. Pat. No. 4,040,223, U.S. Pat. No. 4,696,136, U.S. Pat. No. 4,823,533, U.S. Pat. No. 5,881,528, U.S. Pat. No. 6,009,683 and U.S. application Ser. No. 09/316,733, which are commonly owned by the assignee of the present invention and the disclosures of which are expressly incorporated by reference herein.

As illustrated in FIG. 1, bullnose cladding system 20 includes a plurality of end-to-end panel sections 26 interconnected in an apparent continuous fashion. Bullnose cladding system 20 has a semi-circular or half-round configuration which gives the appearance of extending from vertical surface 22. A light source (not shown) may be located on vertical surface 22 beneath bullnose cladding system 20 for providing an illuminated fascia.

With particular reference to FIGS. 5*a*–5*d*, bullnose cladding system 20 includes an upper longitudinal rail 28 and a lower longitudinal rail 30 secured to vertical surface 22 in a parallel spaced-apart relationship. The edges of panel 26 are received within longitudinal rails 28, 30 for releasably securing panel 26 to support surface 22. The distance between longitudinal support rails 28, 30 are such that panel 26 bows outwardly in a semi-circular configuration. One skilled in the art will readily recognize that lower longitudinal rail 30 is identical in design to upper longitudinal rail 28 and positioned on vertical surface 22 in a symmetrical manner about the longitudinal axis A. As such, further description of longitudinal rails 28, 30 and the features contained therein will be in reference to longitudinal rail 28 in the singular.

Figure 4D:
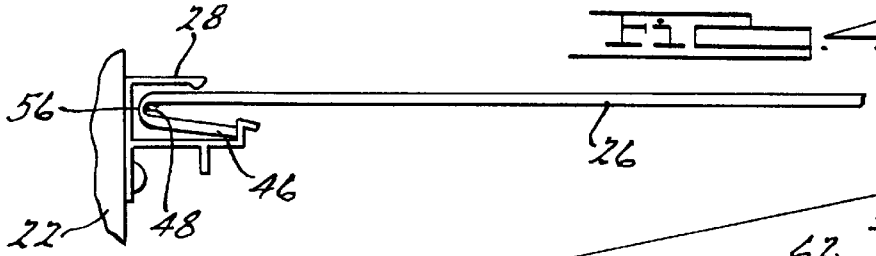

With reference now to FIGS. 2–4, longitudinal rail 28 has a generally F-shaped cross-section including vertical flange 32, upper horizontal flange 34 and lower horizontal flange 36 extending outwardly from vertical flange 32. Rail 28 may also include a second vertical flange 38 extending downwardly from a bottom surface of lower horizontal flange 36 for providing additional stiffness to longitudinal rail 28. Lip portion 40 is formed at the end of lower horizontal flange 36. Similarly, bead 42 is formed at the terminal end of upper horizontal flange 34. Upper horizontal flange 34 and lower horizontal flange 36 define a channel 44 therebetween which is adapted to receive and releasably secure panel 26 to longitudinal rail 28. Longitudinal rails 28, 30 are preferable fabricated from a suitable aluminum alloy which is extruded to form the desired configuration.

Longitudinal rail 28 may be secured to vertical surface 22 by any suitable fastening means. For example, a threaded fastener 45 may be inserted through vertical flange 32. Other mechanical fasteners, as well as adhesive fasteners may be utilized for this purpose. In certain application, upper horizontal flange 34 may extend rearwardly (away from channel 44) beyond vertical flange 32 to provide a trim surface which conceals variations in the supporting surface.

With reference now to FIGS. 3 and 4*a*–4*d*, a panel 26 is configured such that an edge portion 46 may be folded underneath the central portion of panel 26 to form a hem. In this regard, a groove or living hinge 48 is formed on the interior surface of panel 26 which allows hem 46 to be folded back onto panel 26. When hem 46 is folded back upon panel 26, inner corners 52, 54 engage one another to provide a biasing or restoring force which urges hem 46 away from panel 26. Once hem 46 is formed, the folded edge 56 of panel 26 may be inserted into channel 44 such that hem 46 is captured between panel 26 and flange 36. The upper surface of panel 26 engages upper horizontal flange 34 so that panel 26 is securely retained to longitudinal rail 28. As best illustrated in FIG. 3, lip 40 supports a portion of panel 26 proximate to folded edge 56 for forming the semi-circular configuration of bullnose cladding system 20. Specifically, lip 40 is disposed at a slight acute angles which complements the slope of panel 26 at longitudinal rail 28.

The configuration of hem 46 and living hinge 48 is dependent upon the thickness of material used for panel 26 as well as the geometry of channel 44 and the radius of curvature for the bullnose cladding. In one presently preferred embodiment, panel 26 is formed of an extruded thermoplastic material such as Surlyn SG201U available from DuPont and having a thickness of approximately 0.078 inches. With this material, it has been found that a hem length of approximately 0.5625 inch and a living hinge width of approximately 0.25 inch and thickness of approximately 0.020 inch provides an effective living hinge to fold hem 46 beneath panel 26.

With reference to FIG. 8, an alternate embodiment for hem and living hinge in accordance with the present invention is illustrated. Specifically, panel 26' is formed with a contoured groove or living hinge 48' such that inner corners 52', 54' ramp upwardly away from the inner surface of pane 26'. An intermediate ridge 53' is formed in living hinge 48'. When panel 26' is folded to form hem 46', intermediate ridge 53' and inner corners 52', 54' engage one another to provide the biasing or restoring force. The design of living hinge 48' adds robustness by minimizing the thinned cross-section therethrough. Referring to FIG. 9, living hinge 48' may be formed as a subsequent coining process in which a power coining roll CR having a contoured face F is run along the inner face of panel 26'. However, one skilled in the art will recognize that other processes such as extrusion, routing, milling, cutting or other machining operations may be employed to form a living hinge.

Figure 5A:
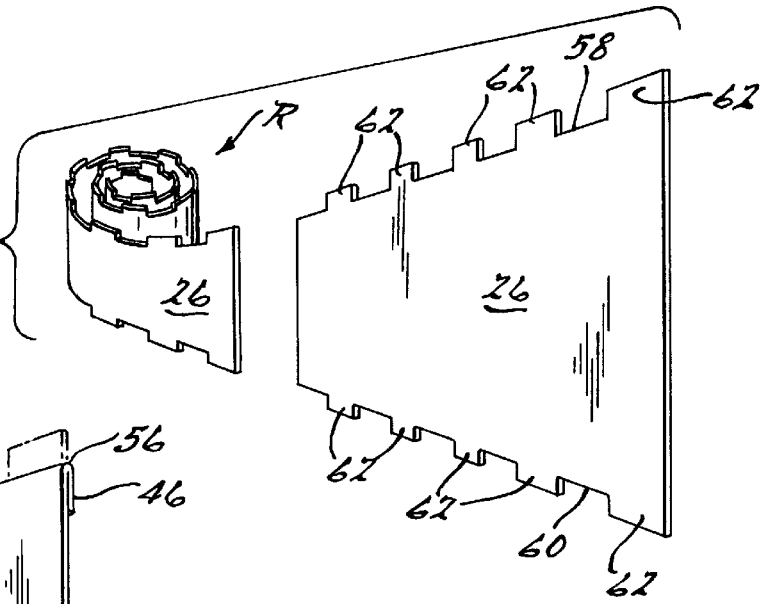
Figure 5B:
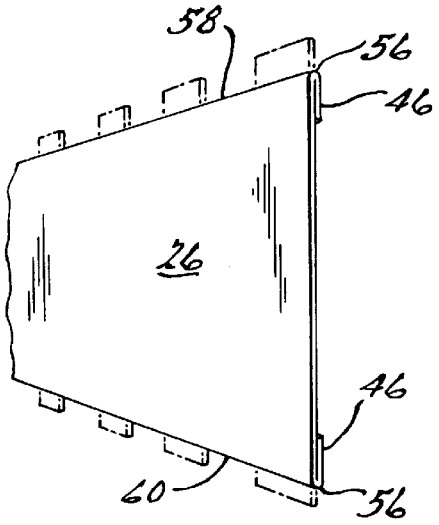
Figure 5C:
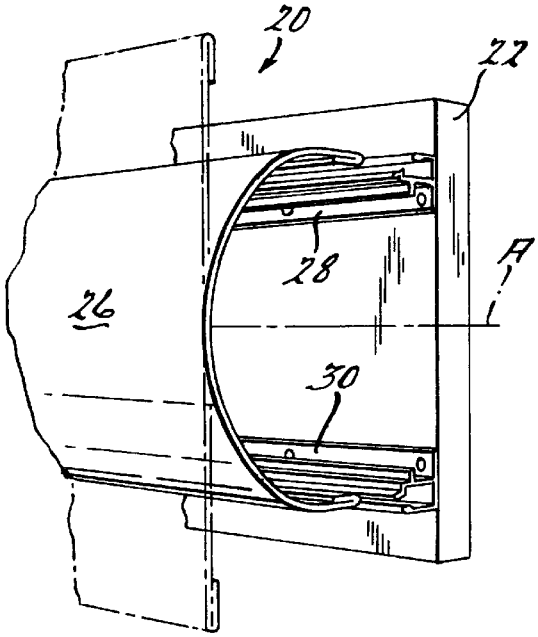

With reference now to FIGS. 5*a* and 5*b*, it can be seen that the longitudinal edges 58, 60 of panel 26 are formed with a series of fingers 62 extending outwardly therefrom. In this manner, a series of hems may be formed along the longitudinal edges of panel 26 for facilitating the insertion of folded edge 56 into longitudinal rail 28. For example, a long roll R of panel material 26 may be utilized without requiring the entire length of hem 56 to be folded beneath panel 26. Instead, fingers 62 are locally folded beneath panel 26 to form hem 56 which are then individually inserted into longitudinal rail 28. Alternately, panel 26 may be provided with a continuous longitudinal edge (not shown) such that a continuous hem may be formed along the entire length of panel 26 which is continuously inserted into longitudinal rail 28.

With reference now to FIGS. 6*a* and 6*b*, the bullnose cladding system 20 may further include a suitable corner member which cooperates with adjacent panels 26 to form a mitered corner. While a mitered corner has been shown, one skilled in the art would recognize that a rounded corner could also be provided by a corner member. With particular reference to FIG. 6*a*, corner piece 70 is provided with a pair of semi-circular surfaces 72, 74 which intersect at a right angle to form a mitered joint 76. The upper and lower edges of corner piece 70 are received within channel 44 of longitudinal rails 28, 30. A flange 78 extends from the transverse edge of arcuate surfaces 72, 74 and slide beneath adjacent panels 26 to provide a slip plane between panel 26 and corner piece 70. Furthermore, flanges 78 support the back surface of panel 26 for maintaining the semi-circular configuration thereof. With reference to FIG. 6*b*, corner piece 70' is illustrated in which semi-circular panels 72', 74' intersect at miter joint 76'. Panels 72', 74' extend over the outer surface of panel 26 and provide a slip plane therebetween. As presently preferred, corner pieces 70, 70' are vacuum formed components. While the mitered corners 70, 70' illustrated in FIGS. 6*a* and 6*b* are outside corners, one skilled in the art will readily recognize that interior corners could be formed in a like fashion.

With reference now to FIGS. 7*a* and 7*b*, the bullnose cladding system 20 may further include suitable expansion joints for panel 26 is illustrated which may accommodate thermal expansion of panels 26 in bullnose cladding system 10. For example, as illustrated in FIG. 7*a*, backing plate 80 has a pair of longitudinal edges which are received in longitudinal rails 28, 30 such that the backing plate supports the edges of adjacent panels 26 from beneath. A slip plane is provided between backing plate 80 and panels 26 to allow for expansion and contraction thereof. With reference now to FIG. 7*b*, an arcuate cover plate 80' is provided having longitudinal edges which are received within longitudinal rails 28, 30. Outwardly extending flanges 82' are disposed over panel 26 and provide a slip plane therebetween to accommodate expansion and contraction of panels 26. As presently preferred, expansion joint 80, 80' are a vacuum formed component.

As previously indicated, the bullnose cladding system of the present invention provides a panel which may be releasably secured to a pair of longitudinal rails without the additional use of pins or clips to secure the panel to the rails. Similarly, panel 26 may be removed from longitudinal rails by positioning a tool beneath hem 46 so that the hem 46 may be urged toward panel 26 in a relatively parallel manner. Once in this position, folded edge 56 of panel 26 may be extracted from channel 44, thereby freeing panel 26 from longitudinal rails 28, 30. In view of the need to compress hem 46 against panel 26, it is contemplated that a screwdriver or other tool will be required for disassembling panel 26 from rail 28, 30. In this regard, the present invention provides a tamper-resistant bullnose fascia design which may frustrate vandalism attempts to the system.

While the present invention has been described in connection with its presently preferred embodiment, the invention is capable of certain modifications and changes without departing from the spirit of the invention as set forth in the appended claims.

What is claimed is:

1. A bullnose cladding system comprising:

a pair of elongated frame members positioned in a generally parallel spaced-apart relationship, each of said pair of elongated frame members having a channel formed therein;

a panel member including a pair of longitudinal edges and an interior panel portion, each of said longitudinal edges folded underneath the interior panel portion to define a folded edge and a hem; and wherein the folded edge is inserted into the channel such that an outer portion of the hem engages a first interior surface of the channel and an inner portion of the hem engages a second interior surface of the channel for securely attaching the panel member to the frame member.

2. The cladding system of claim 1 wherein each of said pair of longitudinal edges of said panel includes a plurality of fingers extending therefrom, the fingers being folded beneath the panel to provide the hem.

3. The cladding system of claim 1 wherein an inner surface of the panel member is provided with a living hinge, the hem being defined between the living hinge and the longitudinal edge.

4. The cladding system of claim 3 wherein the living hinge has a contoured configuration.

5. The cladding system of claim 4 wherein the contoured configuration of the living hinge includes a pair of ramped corners.

6. The cladding system of claim 4 wherein the contoured configuration of the living hinge includes a ridge formed in between a pair of corners.

7. The cladding system of claim 1 wherein each of the pair of elongated frame members has a first flange, a second flange extending away from the first flange and a third flange generally parallel to the second flange, wherein the first, second and third flanges define the channel therebetween.

8. The cladding system of claim 7 wherein the second flange has a lip formed thereon to support the panel in a deflected configuration.

9. The cladding system of claim 7 wherein the third flange has a bead formed thereon to retain the folded edge in the channel.

10. The cladding system of claim 7 further comprising a fourth flange extending from the second flange which is generally parallel to and spaced-apart from the first flange.

11. The cladding system of claim 1 further comprising an expansion joint formed between a transverse edge of adjacent panels for accommodating dimensional variations therebetween.

12. The cladding system of claim 1 further comprising a corner member interconnecting a pair of panels intersecting one another at an angle less than 180 degrees.

13. The cladding system of claim 12 wherein the corner member interconnects the pair of panels intersecting at approximately right angles.

14. A method of assembling a cladding system comprising the steps of:

securing a pair of elongated frame members, to a support in generally parallel, spaced-apart relationships;

folding a first longitudinal edge of a flat panel to form a first hem;

inserting the first hem into a first channel formed in one of the pair of elongated frame members;

folding a second longitudinal edge of the flat panel to form a second hem; and inserting the second hem into a second channel formed in another of the pair of elongated frame members such that the flat panel bows outwardly in a curved configuration.

15. The method of assembling a cladding system of claim 14 wherein the first and second longitudinal edges have a plurality of fingers extending therefrom such that the first and second hems are formed by folding said plurality of fingers.

16. The method of assembling a cladding system of claim 14 further comprising the steps of:

folding a first longitudinal edge of a second panel to form a third hem;

inserting the third hem into the first channel;

folding a second longitudinal edge of the second panel to form a fourth hem;

inserting the fourth hem into the second channel; and positioning the second panel adjacent to the first panel.

17. The method of assembling a cladding system of claim 16 wherein the first and second panels are positioned in an end-to-end relationship.

18. The method of assembling a cladding system of claim 17 further comprising the step of inserting a backing plate between the first and second panels such that a slip plane is provided therebetween.

19. The method of assembling a cladding system of claim 16 wherein the first and second panels intersect one another at an angle less than 180 degrees.

20. The method of assembling a cladding system of claim 19 further comprising the step of inserting a corner member between the first and second panels such that a slip plane is provided therebetween.

21. A bullnose cladding system comprising:

a frame assembly including a first elongated frame member having a first channel formed therein and a second elongated frame member having a second channel formed therein, a flat panel member including first and second longitudinal edges and an interior panel portion;

said first longitudinal edge folded underneath said interior panel portion to define a first folded edge and a first hem, wherein said first folded edge is inserted into said first channel such that said first hem is contained therein;

said second longitudinal edge folded underneath said interior panel portion to define a second folded edge and a second hem, wherein said second folded edge is inserted into said second channel such that said second hem is contained therein; and said second frame member positioned in generally parallel spaced-apart relationship with said first frame member such that said flat panel bows outwardly in a curved configuration.

22. The cladding system of claim 21 wherein each of said pair of longitudinal edges of said panel includes a plurality of fingers extending therefrom, the fingers being folded beneath the panel to provide the hem.

23. The cladding system of claim 21 wherein an inner surface of the panel member is provided with a living hinge, the hem being defined between the living hinge and the longitudinal edge.

24. The cladding system of claim 23 wherein the living hinge has a contoured configuration.

25. The cladding system of claim 24 wherein the contoured configuration of the living hinge includes a pair of ramped corners.

26. The cladding system of claim 24 wherein the contoured configuration of the living hinge includes a ridge formed in between a pair of corners.

27. The cladding system of claim 21 wherein each of the pair of elongated frame members has a first flange, a second flange extending away from the first flange and a third flange generally parallel to the second flange, wherein the first, second and third flanges define the channel therebetween.

28. The cladding system of claim 27 wherein the second flange has a lip formed thereon to support the panel in a deflected configuration.

29. The cladding system of claim 27 wherein the third flange has a bead formed thereon to retain the folded edge in the channel.

30. The cladding system of claim 27 further comprising a fourth flange extending from the second flange which is generally parallel to and spaced-apart from the first flange.

31. The cladding system of claim 21 further comprising an expansion joint formed between a transverse edge of adjacent panels for accommodating dimensional variations therebetween.

32. The cladding system of claim 21 further comprising a corner member interconnecting a pair of panels intersecting one another at an angle less than 180 degrees.

33. The cladding system of claim 32 wherein the corner member interconnects the pair of panels intersecting at approximately right angles.

* * * * *

UNITED STATES PATENT AND TRADEMARK OFFICE

CERTIFICATE OF CORRECTION

PATENT NO. : 6,385,939 B1
DATED : May 14, 2002
INVENTOR(S) : Jeffry B. Stout

It is certified that error appears in the above-identified patent and that said Letters Patent is hereby corrected as shown below:

Column 1,
Line 16, after “use” delete “a”;
Line 62, “assembly” should be -- assembled --;

Column 2,
Line 9, “which” should be -- when --;
Line 53, “represent” should be -- represents --;

Column 3,
Line 27, “preferable” should be -- preferably --;
Line 54, “angles” should be -- anglea --;

Column 4,
Line 59, “is” should be -- as --.

Signed and Sealed this

Tenth Day of December, 2002

JAMES E. ROGAN
*Director of the United States Patent and Trademark Office*